US006167643B1

(12) United States Patent
Dodier et al.

(10) Patent No.: US 6,167,643 B1
(45) Date of Patent: Jan. 2, 2001

(54) IRON WITH NON-DRIP DEVICE

(75) Inventors: Phillippe Dodier, Sainte Foy les Lyon; Jean-Louis Brandolini, Thurins, both of (FR)

(73) Assignee: SEB S.A.,, Ecully (FR)

( * ) Notice: Under 35 U.S.C. 154(b), the term of this patent shall be extended for 0 days.

(21) Appl. No.: 09/482,610

(22) Filed: Jan. 14, 2000

Related U.S. Application Data

(63) Continuation-in-part of application No. PCT/FR98/01503, filed on Jul. 10, 1998.

(51) Int. Cl.[7] ..... D06F 75/18
(52) U.S. Cl. ..... 38/77.8
(58) Field of Search ..... 38/74, 77.3, 77.7, 38/77.8, 77.82, 77.83; 219/245, 254, 251

(56) References Cited

U.S. PATENT DOCUMENTS 2,749,633 * 6/1956 Seck ..... 38/77.7
2,865,119 * 12/1958 Pratt ..... 38/77.7
4,125,953 11/1978 Colombo .
4,567,679 2/1986 Kraft et al. .
4,627,181 12/1986 Bastida .
4,837,952 * 6/1989 Hennuy et al. ..... 38/77.7

FOREIGN PATENT DOCUMENTS 2 358 498 2/1978 (FR) .
2 558 181 7/1985 (FR) .
2 183 257 3/1987 (GB) .

* cited by examiner

*Primary Examiner*—Ismael Izaguirre
(74) *Attorney, Agent, or Firm*—Browdy and Neimark

(57) ABSTRACT

A steam pressing iron having a sole plate 11 provided with steam outlet holes 12 communicating with an evaporation chamber 14, the sole plate 11 and the evaporation chamber 14 being in thermal communication with a heating device, the evaporation chamber 14 communicating with a reservoir 15 via an orifice 16 capable of being blocked by a valve 17 disposed in a housing 52. The valve 17 includes a rod 5 capable of blocking the orifice 16, the rod having a shoulder 19 capable of resting on a support 3 that is fixed to a bellows 4 forming at least one part of a water tight conduit 31 between the reservoir 15 and the evaporation chamber 14, the support 3 being capable of being actuated by a bimetallic strip 1 mounted on a wall in thermal communication with the evaporation chamber 14.

13 Claims, 10 Drawing Sheets

IRON WITH NON-DRIP DEVICE

This application is a continuation-in-part of PCT/FR98/01503 filing date Jul. 10, 1998.

BACKGROUND OF THE INVENTION

The present invention relates to the field of appliances provided for the care of textile articles such as clothing, by subjecting them to the combined action of a thermal treatment, a mechanical treatment and a steam treatment.

The invention concerns more particularly an electric steam iron having a sole plate containing outlet holes communicating with an evaporation chamber which is heated by means of a heating circuit that is in thermal communication with a temperature regulating or control device, the chamber communicating with a water reservoir through an orifice capable of being blocked by a valve, the valve permitting control of the flow of water from the reservoir into the evaporation chamber.

It is already known in the art to provide such a pressing iron with a removable valve, which offers the advantage of being able to easily clean the valve, and thus counter the buildup of scale.

It is also known to provide a pressing iron in which the valve can be maneuvered by means of a control device to occupy at least one steaming position, in which the valve at least partially opens the orifice connecting the reservoir to the evaporation chamber. An iron having several steaming positions differing as to the rate at which water is admitted into the evaporation chamber offers the advantage of permitting the user to regulate the quantity of steam emitted, in order to adapt it to the more or less creased state of the article or to the nature of the fabric to be ironed. Such an arrangement presents however the drawback of allowing the water to flow through the sole plate holes when the temperature of the evaporation chamber is insufficient to evaporate all of the water admitted into the chamber, for example during ironing of a delicate fabric requiring low sole plate temperatures, and for which the thermostat of the appliance has been set to an assigned low temperature. Such an arrangement also has the drawback of requiring the user to regulate, as a function of the nature of the fabric to be ironed, at the same time the thermostat of the appliance and the quantity of water admitted into the evaporation chamber, in order to prevent drops of water which have not evaporated from exiting through the holes in the sole plate.

BRIEF SUMMARY OF THE INVENTION

An object of the invention is to overcome the above-mentioned drawbacks and to provide a pressing iron having a removable valve in which the water contained in the reservoir is only admitted into the evaporation chamber when the temperature within the chamber is sufficient to permit evaporation of the totality of the water arriving into the chamber.

Objects of the inventions are achieved in a steam pressing iron having, as shown in FIG. 1, a sole plate 11 provided with steam outlet holes 12 communicating with an evaporation chamber 14, the sole plate 11 and the evaporation chamber 14 being in thermal communication with heating means, the evaporation chamber 14 communicating with a reservoir 15 via an orifice 16 capable of being blocked by a valve 17 disposed in a housing 52. According to the invention, the valve 17 includes a rod 5 capable of blocking the orifice 16, the rod having a shoulder 19 capable of resting on a support 3 that is fixed to a bellows 4 forming at least one part of a water tight conduit 31 between the reservoir 15 and the evaporation chamber 14, the support 3 being capable of being actuated by a bimetallic strip 1 mounted on a wall in thermal communication with the evaporation chamber 14.

BRIEF DESCRIPTION OF THE DRAWINGS

Other particularities and advantages of the invention will become more readily apparent from the following description presented with reference to the accompanying drawings which illustrate non-limiting examples of the invention.

DETAILED DESCRIPTION OF THE INVENTION

Figure 1:
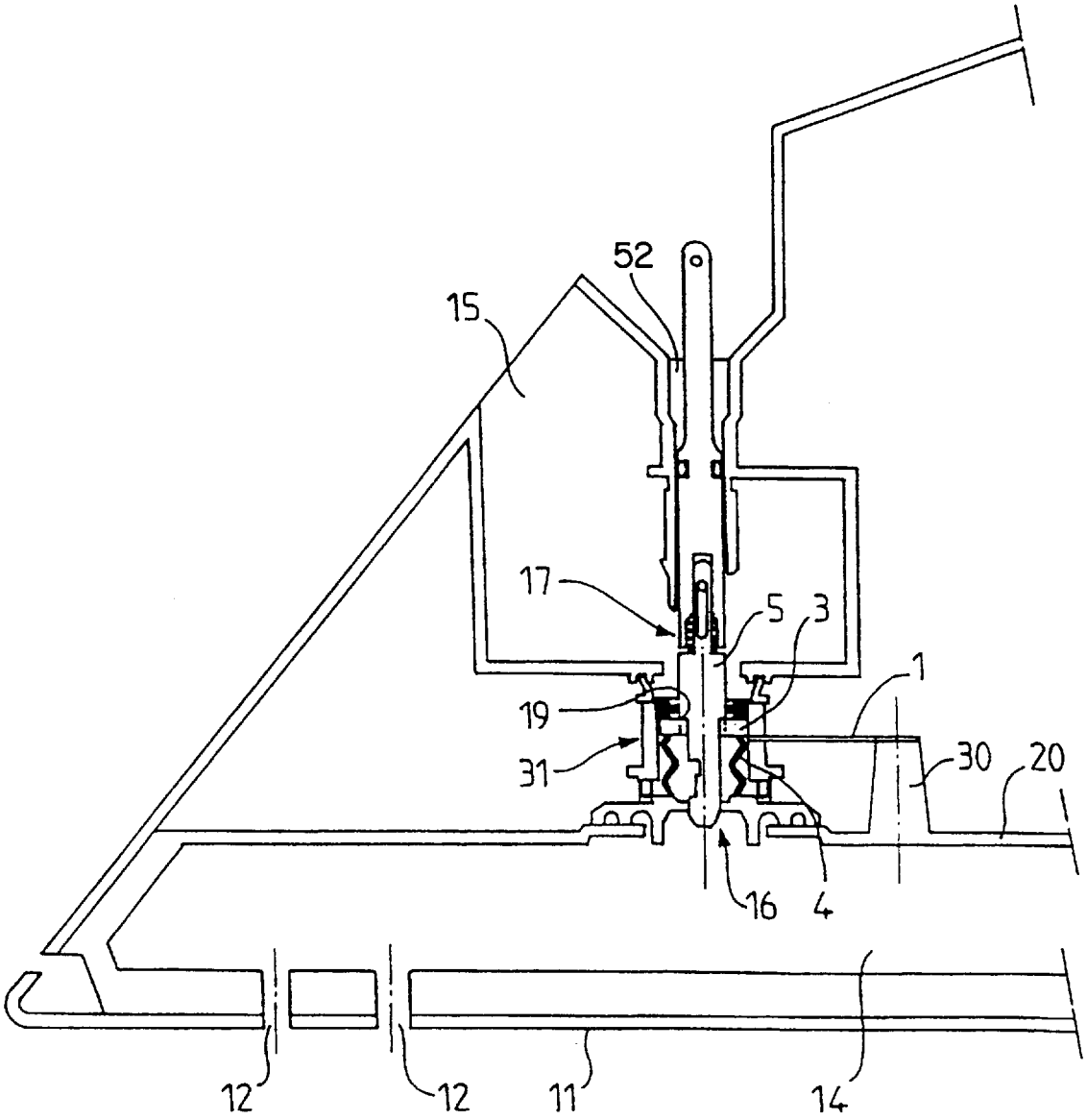
FIG. 1 is an elevational, cross-sectional view of a portion of an iron according to the invention.

A steam iron according to the invention is shown in FIG. 1. The iron includes a sole plate 11 having steam outlet, or delivery, holes 12 in communication with an evaporation chamber 14. Sole plate 11 and evaporation chamber 14 are in thermal communication with heating means (not shown). Evaporation chamber 14 communicates with a reservoir 15 via an orifice 16 capable of being blocked by a valve 17 disposed in housing 52 in order to facilitate cleaning of valve 17, as well as cleaning of the interior of housing 52 and orifice 16.

According to an important feature of the invention, valve 17 includes a rod 5 capable of blocking orifice 16. Rod 5 is provided with a shoulder 19 capable of resting on a support 3 fixed to a bellows 4 forming at least one part of a watertight conduit 31 between reservoir 15 and evaporation chamber 14. Support 3 is positioned to be acted on by a bimetallic strip 1 mounted on a wall 20 in thermal communication with evaporation chamber 14. As shown particularly in FIG. 1, bimetallic strip 1 is fixed on a boss, or pedestal, 30 disposed on wall 20. Wall 20 and boss 30 are made of a material which is a good conductor of heat, such as aluminum, in a manner to transmit a thermal image of evaporation chamber 14 to bimetallic strip 1.

Figure 2:
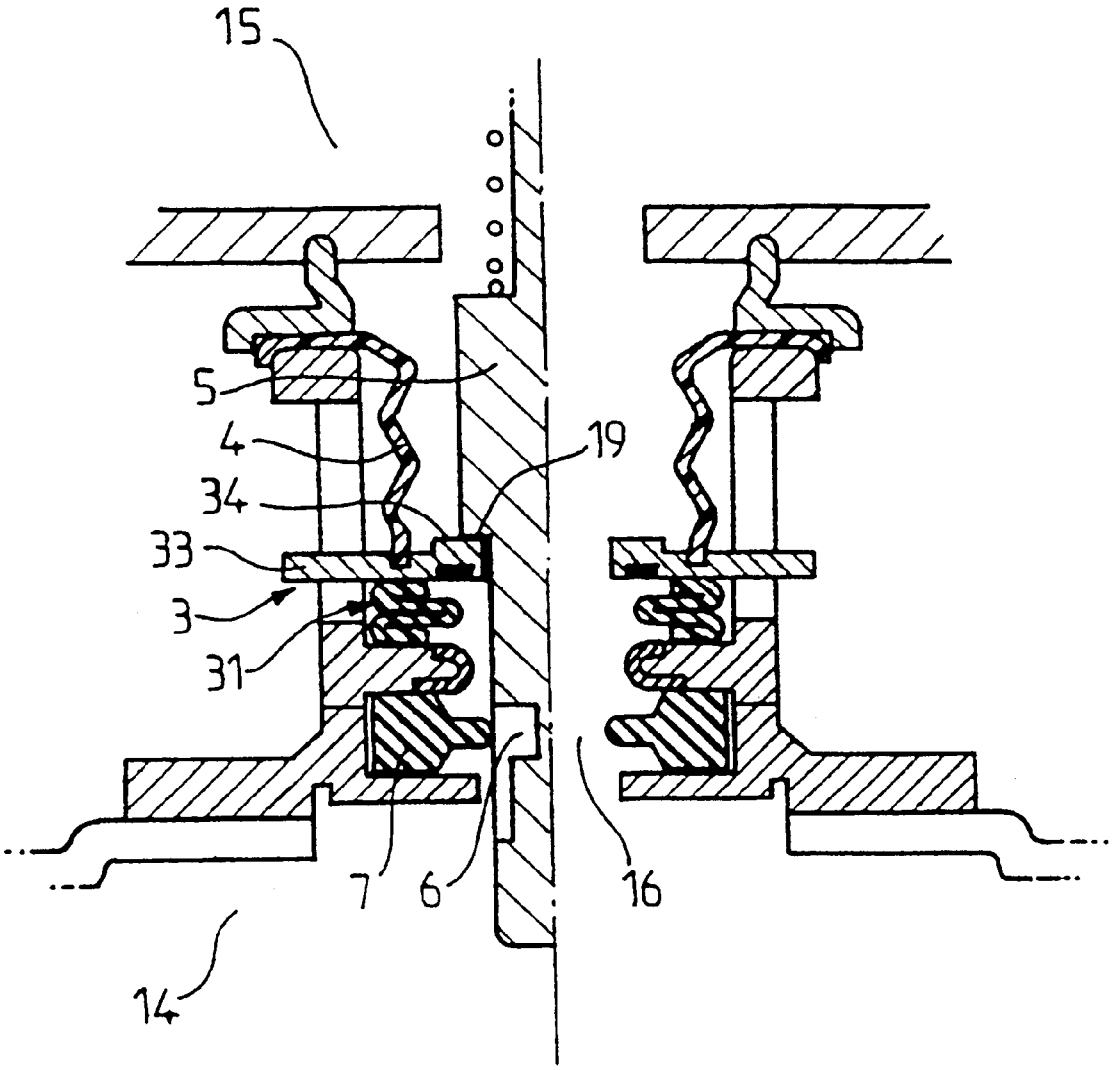
FIG. 2 is a cross-sectional detail view of one form of construction of components of the iron of FIG. 1.

Advantageously, the walls of orifice 16 form a valve seat 7, and rod 5 includes a groove 6 past which water can flow into evaporation chamber 14 when groove 6 is disposed opposite valve seat 7, as shown in FIG. 2.

Figure 3:
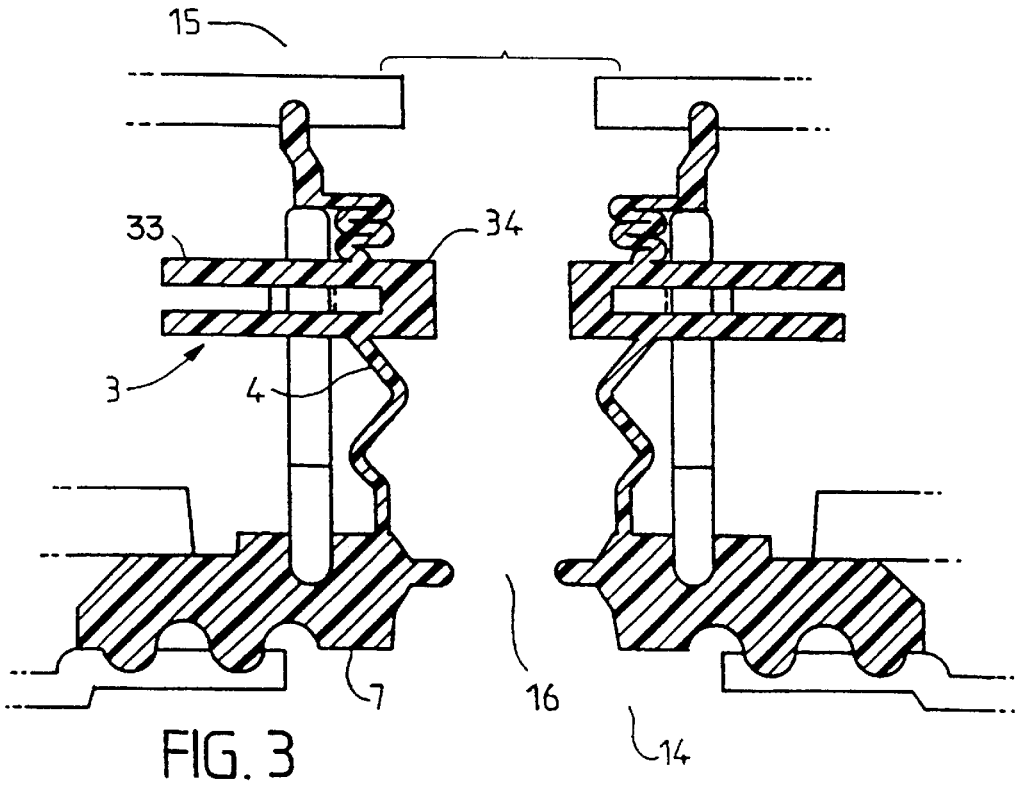
FIGS. 3 and 4 are views similar to that of FIG. 2 showing modified forms of construction of the components shown in FIG. 2.
Figure 4:
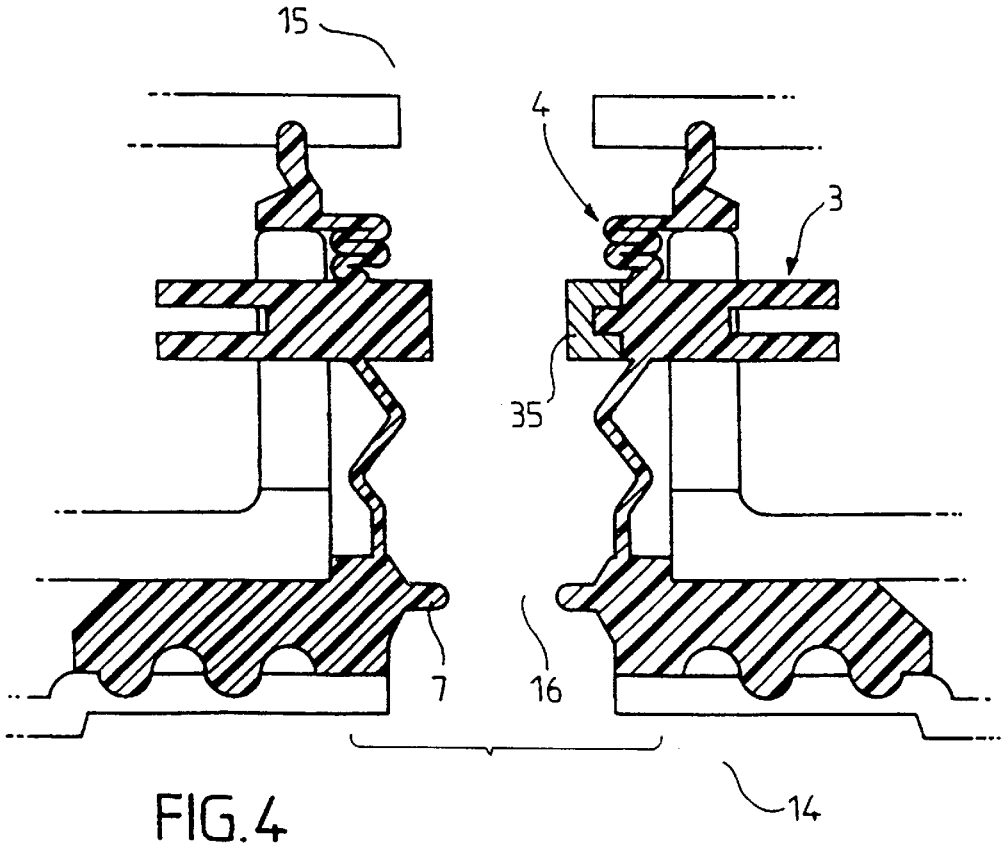

FIGS. 2, 3 and 4 illustrate three forms of construction for conduit 31. As shown in FIG. 2, valve seat 7 and bellows 4 are two distinct parts. Support 3 is fixed to bellows 4, the latter advantageously being made of silicone overmolded onto support 3. Support 3 includes an exterior element 33 capable of being acted on by bimetallic strip 1, as well as an interior element 34 on which rod 5 of valve 17 is able to rest. At least one of interior element 34 and shoulder 19 is formed to provide at least one passage for the flow of water within the region enclosed by bellows 4 when shoulder 19 rests on support 3. By way of example, either interior element 34 or shoulder 19 could be provided with one or more grooves or slots through which water can flow even when shoulder 19 bears directly on interior element 34.

In the embodiment shown in FIG. 3, bellows 4, valve seat 7 and support 3 are made in one piece, advantageously of silicone.

In the embodiment shown in FIG. 4, support 3 includes a rigidifying support element 35 disposed within bellows 4.

According to an advantageous feature of the invention, shown in FIGS. 5 to 8, valve 17 includes a body 18 having a blind bore 22 in which rod 5 is movably mounted. Advantageously, valve 17 also includes a bias spring 26 mounted between body 18 and rod 5. As shown in FIGS. 5 to 8, body 18 is provided with a lateral slot 23 that opens into blind bore 22. Rod 5 includes a head 24 that is arranged to slide in blind bore 22. Head 24 carries a lug 25 which projects into, and is slidable along the vertical length of, slot 23.

Body 18, disposed in housing 52, is capable of occupying a first position in which orifice 16 is blocked by rod 5 and a second position in which bimetallic strip 1 can displace, as a function of its temperature, rod 5 through the intermediary of support 3.

Figure 5:
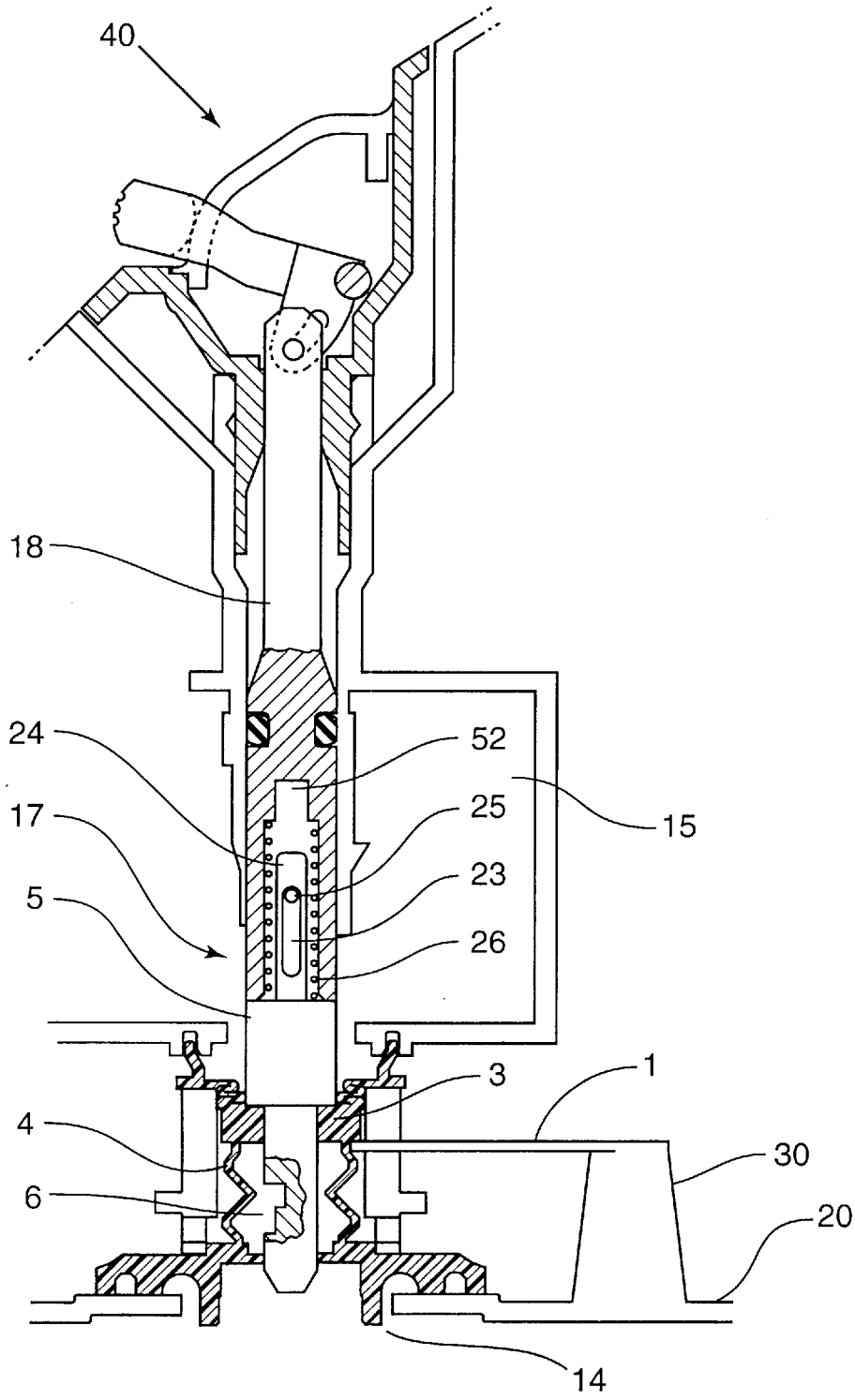
FIG. 5 is a cross-sectional detail view illustrating an iron according to the invention in its maximum steaming position when the evaporation chamber is at a low temperature.
Figure 6:
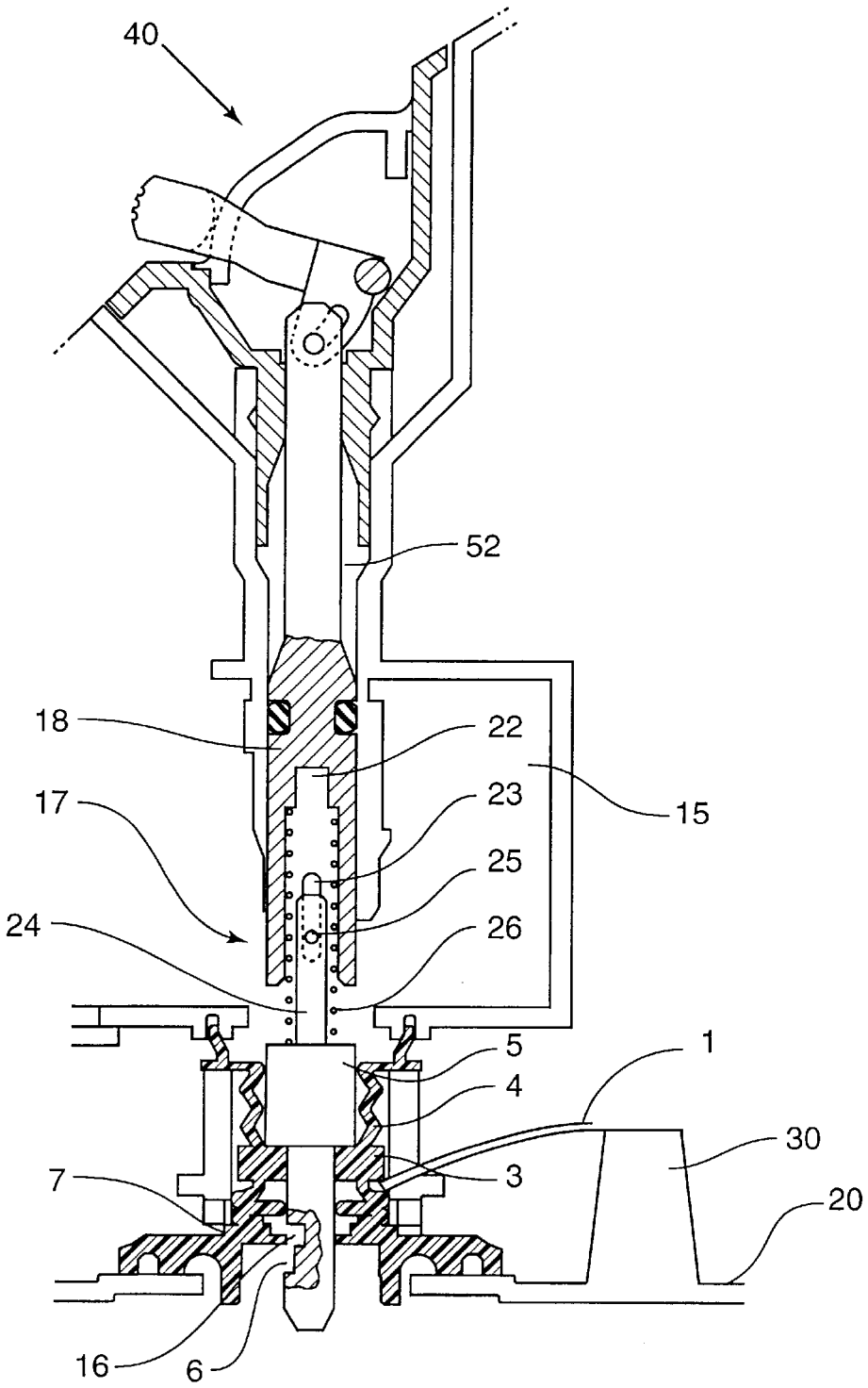
FIG. 6 is a view similar to that of FIG. 5 showing the iron in the maximum steaming position when the evaporation chamber has reached its working temperature.

FIGS. 5 and 6 shown an iron in which body 18 occupies a first position, called herein the maximum steaming position. In FIG. 5, evaporation chamber 14 is at a low temperature at which it can not evaporate water admitted thereto. Bimetallic strip 1 occupies a position in which rod 5 rests on support 3 and obstructs orifice 16 in line with valve seat 7. Thus, when the iron is in the steaming position shown in FIGS. 5 and 6, water is not admitted into evaporation chamber 14 as long as evaporation chamber 14 is too cold to evaporate the water. As a result, there is no risk of water droplets leaking out through steam outlet holes 12.

FIG. 6 shows the operating state when evaporation chamber 14 has reached its working temperature at which all water admitted thereto will be converted to steam. Bimetallic strip I occupies a position in which rod 5 rests on support 3 and groove 6 is disposed in line with valve seat 7, permitting the admission of water into evaporation chamber 14. Thus, when the iron is in the maximum steaming position, or any other steaming position to be discussed below, water admitted into evaporation chamber 14 is completely evaporated so that drops of water will not leak through steam outlet holes 12. Rod 5, having limited vertical mobility with respect to body 18, follows the displacement of support 3 as it is acted on by bimetallic strip 1.

Figure 7:
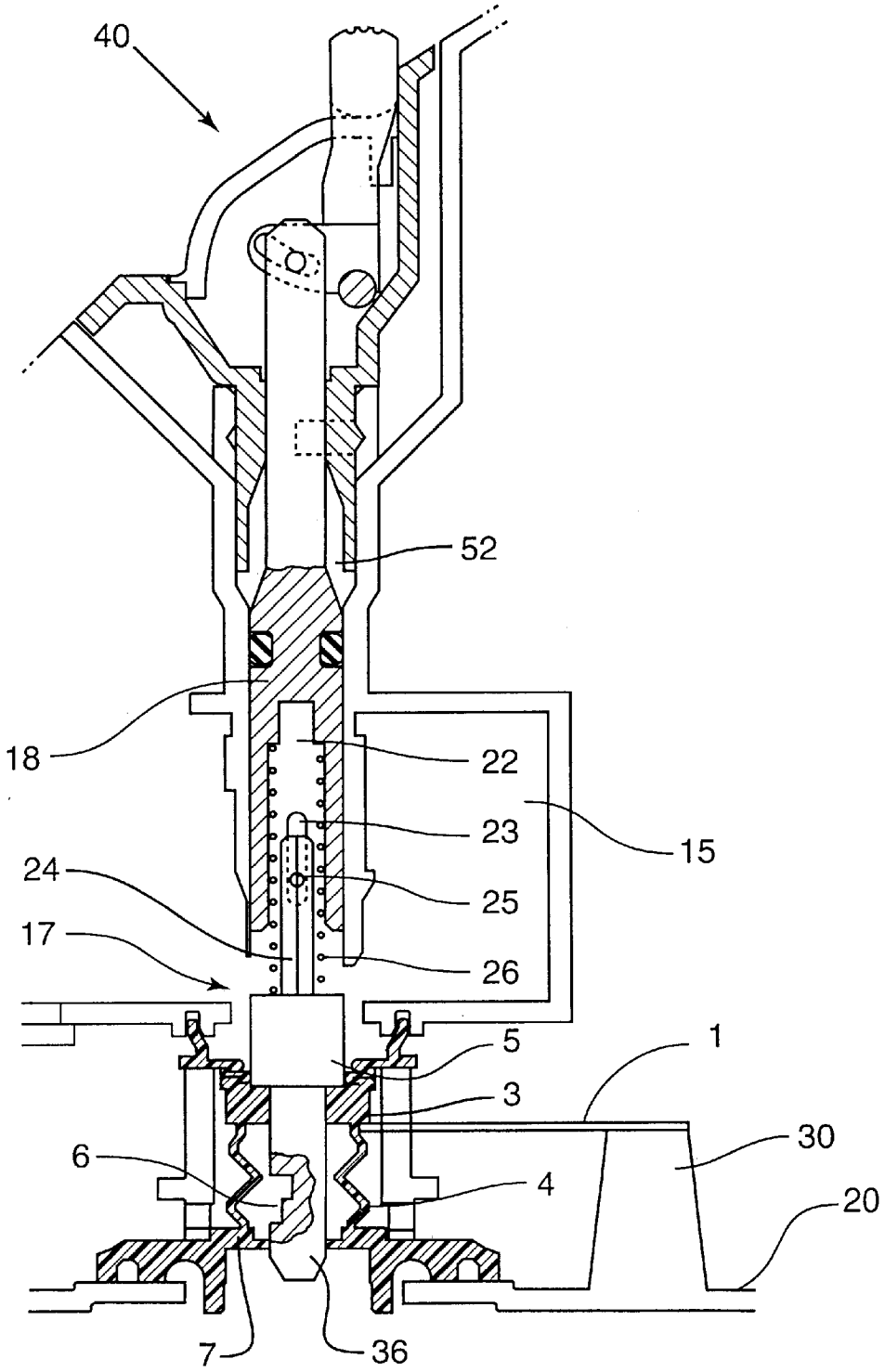
FIG. 7 is a view similar to that of FIG. 5 showing an iron according to the invention in the dry ironing position when the evaporation chamber is at low temperature.
Figure 8:
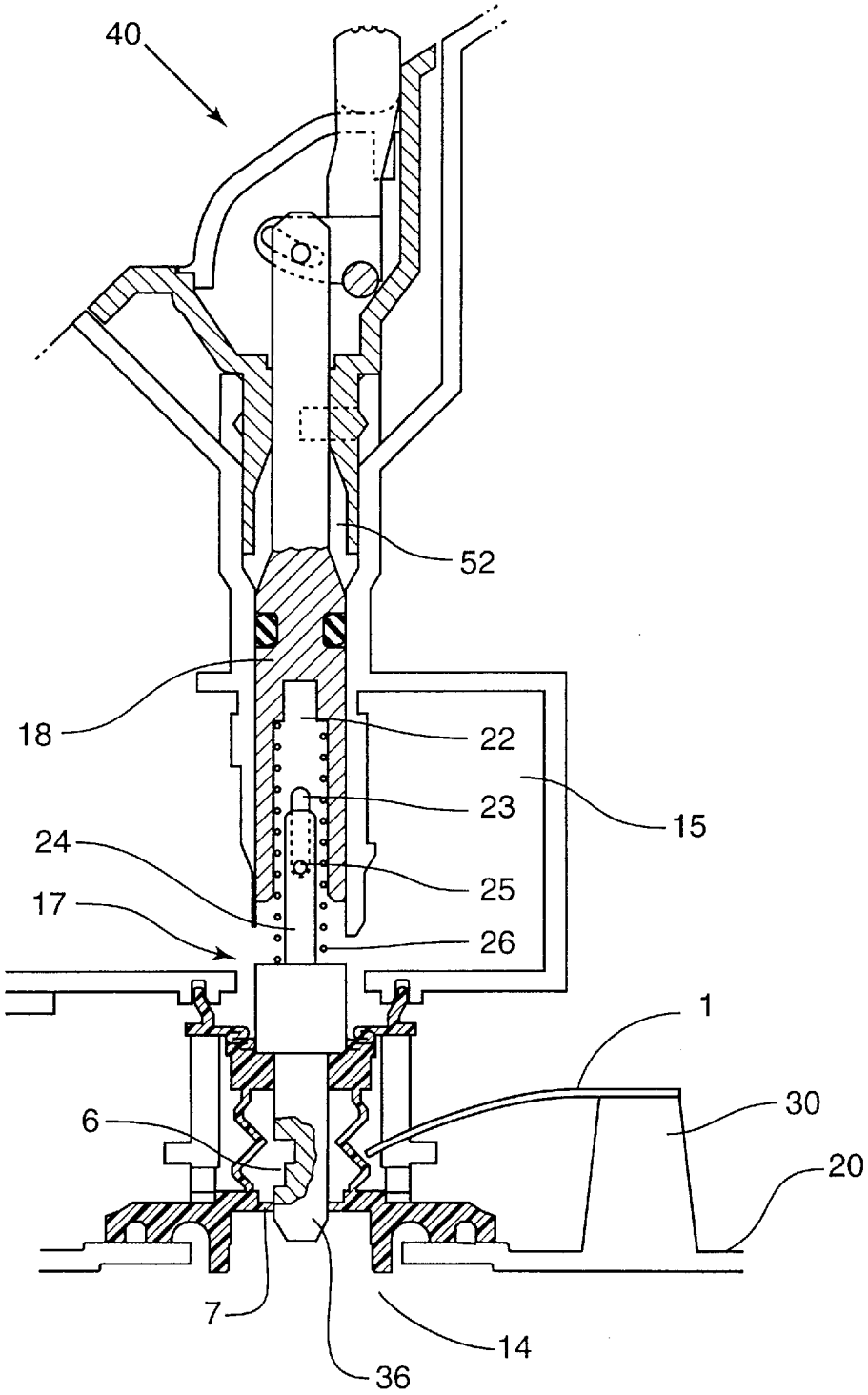
FIG. 8 is a view similar to that of FIG. 5 showing an iron according to the invention in the dry ironing position when the evaporation chamber has reached its working temperature.

FIGS. 7 and 8 show the iron when body 18 occupies a second position, called herein the dry ironing position. In this position, rod 5 blocks orifice 16 by forming a seal with valve seat 7. FIG. 7 shows the state in which bellows 4 is at a low temperature and FIG. 8 shows the state at which bellows 4 has reached its working temperature. Regardless of the temperature existing in evaporation chamber 14, which can be anywhere from ambient temperature to the maximum temperature achieved by the iron in normal use, any displacement of support 3 by bimetallic strip 1 always leaves a part 36 of rod 5 in line with valve seat 7. As shown in these figures, support 3 is maintained in place by rod 5, for example, by dimensioning support 3 to lightly grip, or achieve a light force fit with, rod 5. According to another possibility, not shown, support 3 can rest on bimetallic strip 1. In the operating condition shown in FIG. 8, the lower limit of downward movement of rod 5 relative to body 18 occurs when lug 25 comes to abut against the lower end of slot 23. Rod 5 is biased in a downward direction relative to body 18 by bias spring 26.

The iron includes means 40 which allow the user to move body 18 between the dry ironing position and the various steam ironing positions. One embodiment of means 40 will be described in greater detail below. Means 40 are also constructed to allow removal of valve 17 and 18 for cleaning of valve 17, and of the interior of housing 52 and orifice 16. The user thus has complete freedom to select either dry ironing or steam ironing while assuring that no water will drip out through steam outlet holes 12 during either type of ironing. The iron thus includes an anti-drip feature which remains compatible with removal of the valve for cleaning.

Figure 9:
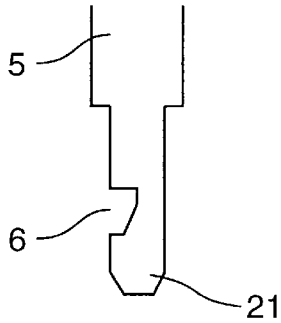
FIG. 9 is a detail view of a modified form of construction of one component of an iron according to the invention.

According to an advantageous form of construction of an iron according to the invention, as shown in FIG. 9, the cross-section of groove 6 increases with the distance from the free end of rod 5. Since the deflection of bimetallic strip 1 increases with increasing temperature, the cross-section of groove 6 disposed opposite valve seat 7 increases with temperature. Thus, the higher the temperature in evaporation chamber 14, the greater the flow rate of water from reservoir 15, and the greater the rate of flow of steam through steam outlet holes 12. This arrangement is desirable because more delicate articles are ironed at low temperature and do not require a significant flow of steam while thicker and more durable articles, which are ironed at high temperature, require a substantial flow of steam. This arrangement permits provision of a steam iron with an anti-drip feature and a steam flow rate which varies with the temperature of the evaporation chamber.

Figure 10:
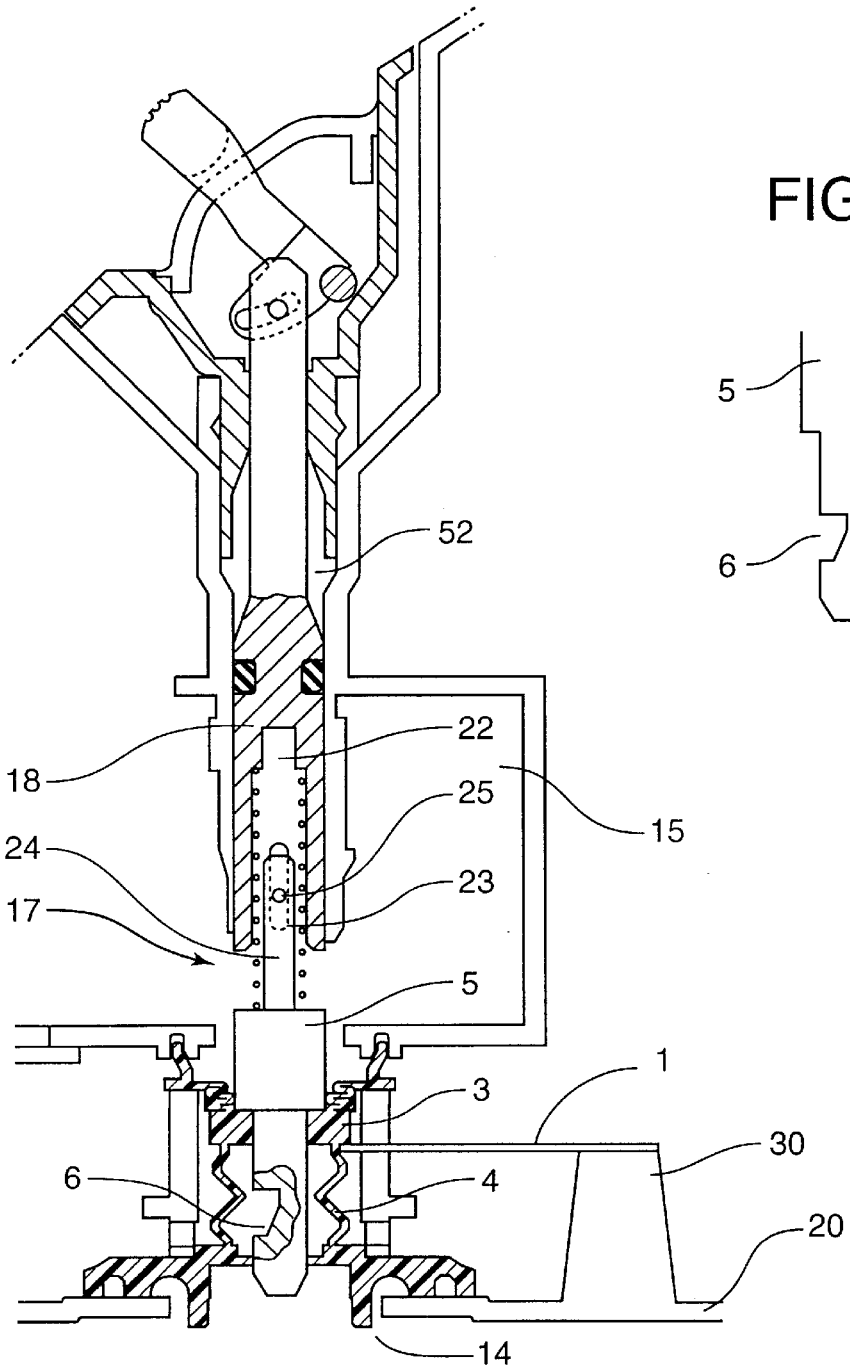
FIG. 10 is a view similar to that of FIG. 5 of an embodiment of the invention which employs the element of FIG. 9 and with the iron in an intermediate position when the evaporation chamber is at ambient temperature.

According to an even more advantageous version of the invention, body 18 is capable of occupying several positions in which bimetallic strip 1 is capable of displacing, as a function of its temperature, rod 5 through the intermediary of support 3. FIG. 10 shows an iron according to the invention in which body 18 occupies an intermediate steam ironing position between the above-described dry ironing position and maximum steam ironing position. In the intermediate position illustrated in FIG. 10, the lowest temperature in evaporation chamber 14 which will cause bimetallic strip 1 to displace support 3 in a manner to bring groove 6 opposite valve seat 7 is higher than the evaporation chamber temperature for which this arrangement intervenes when body 18 is in the maximum steam ironing position. When the crosssection of groove 6 increases with its distance from free end of rod 5, the quantity of water admitted for a given temperature of the evaporation chamber is greater in the maximum steam ironing than in the intermediate steam ironing position. This arrangement permits the provision of a steam iron with an anti-drip device and several steam flow rates.

The invention can be applied equally to irons having several heating means, for example, a heating means provided to preferentially heat sole plate 11 and a heating means provided to preferentially heat evaporation chamber 14. The invention is, of course, particularly useful in the field of electric steam irons.

Figure 11:
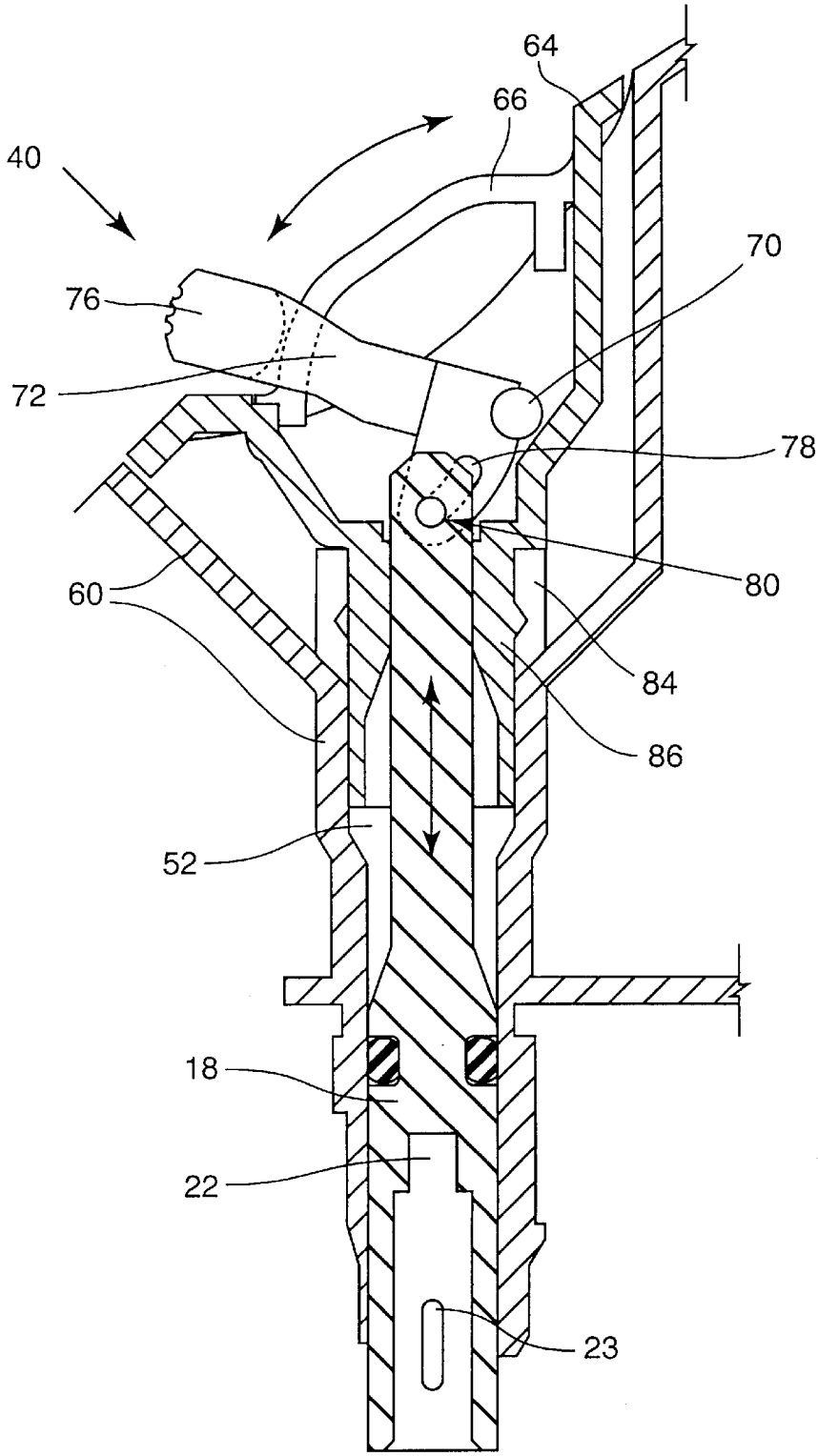
FIGS. 11 and 12 are elevational cross-sectional detail views illustrating one form of construction of means 40 according to the invention for adjusting the position, and allowing removal, of body 18 and the components which it carries.
Figure 12:
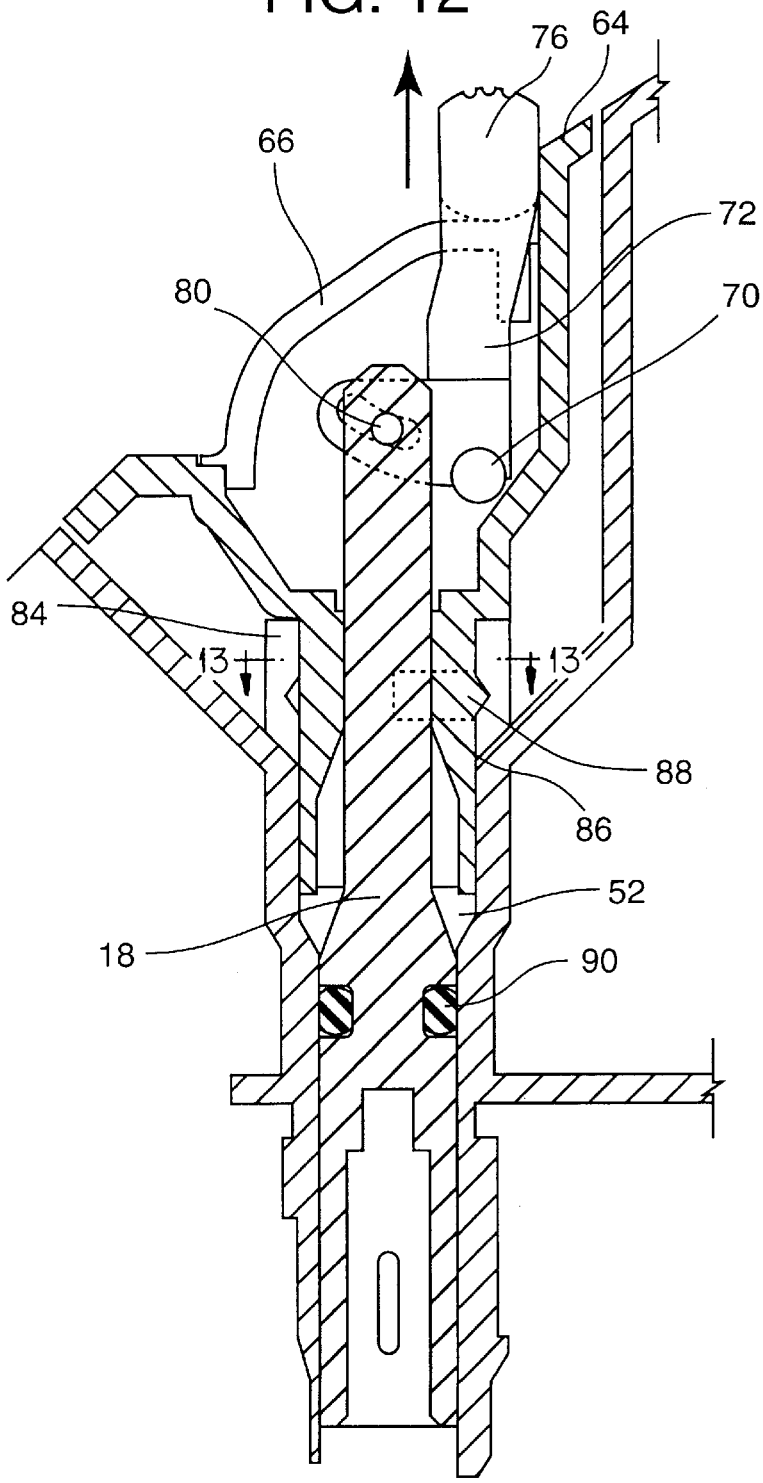
Figure 13:
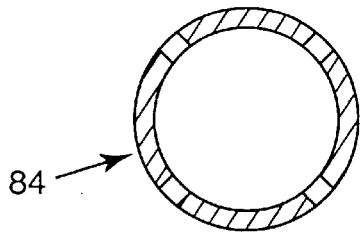
FIG. 13 is a cross-sectional view taken along the line 13—13 of FIG. 12.

One preferred embodiment of a mechanism for placing body 18 into a desired position is illustrated in FIGS. 11–13. As shown therein, the housing of the iron includes walls 60 which define housing 52, as well as a recessed region located above housing 52 and opening at the upper surface of the iron.

Means 40 include an extractable support assembly composed of a hollow housing member 64 and a curved lever guide 66. Housing member 64 carries a pivot pin 70 and a manual control lever 72 mounted to pivot about the axis of pin 70.

Lever 72 is a two-armed, or bell crank, lever having, at one end, a finger grip 76 that may be gripped by a user in order to control the position of body 18 and, at its other end, a slot 78 which receives a pin 80 that is fixed to body 18.

When lever 72 is in the position shown in FIG. 11, body 18 is in its lowermost position, corresponding to the maximum steam ironing position of the iron. When lever 72 is in the position shown in FIG. 12, body 18 is in its uppermost position, corresponding to the dry ironing position of the iron. Lever 72 can also be placed in a position between the positions shown in FIGS. 11 and 12 to place body 18 in a vertical position corresponding to any one of a selected number of intermediate ironing positions.

Lever guide 66 may be provided with suitable indicia which indicate, in cooperation with finger grip 76, the present ironing position of body 18.

Walls 60 include an upwardly projecting portion 84 shown in cross-section in FIG. 13. This portion is vertically slotted in order to have a certain degree of radial flexibility. Housing member 64 is provided, at its lower end, with a downwardly projecting cylindrical portion 86 which fits into housing 52 and engages wall portion 84 when body 18 and valve 17 are installed in the iron. Portion 86 may be provided, for example, with an outwardly projecting part 88 that engages in a mating recess in portion 84 in order to hold housing member 64 in place while permitting it to be extracted, along with body 18 and valve 17, from housing 52. Extraction may be effected, for example, simply by pulling upwardly on lever guide 66, and this can be done when lever 72 is in any position.

Body 18 carries a sealing ring 90 which assures that the space between body 18 and walls 60 will be sealed when body 18 is installed in housing 52.

This application relates to subject matter disclosed in French Application No.97 09389, filed on Jul. 18, 1997, and PCT/FR98/01503, filed Jul. 10, 1998, the disclosures of which are incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A steam pressing iron comprising: a sole plate provided with steam outlet holes; an evaporation chamber communicating with said steam outlet holes; heating means in thermal communication with said sole plate and said evaporation chamber; a reservoir communicating with said evaporation chamber via an orifice; a valve disposed in a housing, said valve including a rod which is positionable for blocking the orifice, means defining a watertight conduit extending between said evaporation chamber and said reservoir, said means including a bellows and a support fixed to said bellows and said rod having a shoulder positionable to rest on said support; and a bimetallic strip mounted on a wall in thermal communication with said evaporation chamber, said bimetallic strip being operatively associated with said support for moving said rod to a position to unblock said orifice when said evaporation chamber is at a steam generating temperature.

2. Iron according to claim 1 wherein the walls of the orifice form a valve seat and the rod has a groove provided for the flow of water when said groove is disposed in line with said valve seat.

3. Iron according to claim 2 wherein the rod has a free end and the groove has a cross-section which increases with increasing distance from the free end.

4. Iron according to claim 3 wherein said bellows, said valve seat and said support are constituted by one-piece element.

5. Iron according to claim 2 wherein said bellows, said valve seat and said support are constituted by one-piece element.

6. Iron according to claim 1 wherein said valve includes a body movably mounted on said rod.

7. Iron according to claim 6 wherein said valve includes a bias spring mounted between said body and said rod.

8. Iron according to claim 5 wherein said body is disposed in a blind bore and is movable between a dry ironing position in which said orifice is permanently blocked by said rod and a steam ironing position in which said bimetallic strip acts to displace said rod by the intermediary of said support as a function of temperature.

9. Iron according to claim 7 wherein said body is displaceable to occupy any one of several different steam ironing positions.

10. Iron according to claim 9 wherein said body comprises a blind bore and a slot communicating with said blind bore, and said rod has a head provided to slide in said blind bore and carrying a lug provided to slide in said slot.

11. Iron according to claim 6 wherein said body comprises a blind bore and a slot communicating with said blind bore, and said rod has a head provided to slide in said blind bore and carrying a lug provided to slide in said slot.

12. Iron according to claim 7 wherein said body comprises a blind bore and a slot communicating with said blind bore, and said rod has a head provided to slide in said blind bore and carrying a lug provided to slide in said slot.

13. Iron according to claim 8 wherein said body comprises a blind bore and a slot communicating with said blind bore, and said rod has a head provided to slide in said blind bore and carrying a lug provided to slide in said slot.

* * * * *